United States Patent [19]

Braemert et al.

[11] Patent Number: 5,031,544

[45] Date of Patent: Jul. 16, 1991

[54] RAILROAD CAR CONNECTION ASSEMBLY WITH MOVABLE PLATFORM ADJUSTABLY CONNECTED TO THE CAR TO COINCIDE WITH MOVEMENT OF CAR BUFFERS

[75] Inventors: Peter Braemert, Wolfenbuttel; Ingo Britzke, Kassel, both of Fed. Rep. of Germany

[73] Assignee: Hubner Gummi - und Kunststoff GmbH, Kassel, Fed. Rep. of Germany

[21] Appl. No.: 440,823

[22] Filed: Nov. 20, 1989

[30] Foreign Application Priority Data

Nov. 24, 1988 [DE] Fed. Rep. of Germany ..... 3839716

[51] Int. Cl.[5] ..... B61D 17/20

[52] U.S. Cl. ..... 105/8.1; 105/458

[58] Field of Search ..... 105/8.1, 15, 18, 458; 213/220, 221, 222

[56] References Cited

U.S. PATENT DOCUMENTS

| | | | |
|---|---|---|---|
| 290,516 | 12/1983 | Beery | 105/458 |
| 608,751 | 8/1898 | Burkhart | 105/458 |
| 701,202 | 5/1902 | Holland et al. | 105/458 |
| 2,315,118 | 5/1941 | Greener | 105/15 |
| 3,410,226 | 11/1968 | Krupp | 105/18 |
| 3,922,971 | 12/1975 | Maroshick | 105/8.1 |
| 4,252,065 | 2/1981 | Bickel et al. | 105/8.1 |
| 4,736,688 | 4/1988 | Ando et al. | 105/18 |
| 4,762,071 | 8/1988 | Ohta et al. | 105/15 |
| 4,802,417 | 2/1989 | Küker et al. | 105/8.1 |
| 4,905,607 | 3/1990 | Wanneroy | 105/8.1 |

FOREIGN PATENT DOCUMENTS

| | | | |
|---|---|---|---|
| 2163113 | 2/1986 | United Kingdom | 105/8.1 |

*Primary Examiner*—Robert J. Oberleitner
*Assistant Examiner*—S. Joseph Morano
*Attorney, Agent, or Firm*—Alan H. Levine

[57] ABSTRACT

A connecting platform for use with the end of a railroad car, the platform cooperating with a connecting platform of another car articulated to the railroad car, both railroad cars having the usual spring-biased buffers. The connecting platform includes a platform part supported on the end of the railroad car and slidable with respect to the car in the longitudinal direction of the car, the end face of the platform part remote from the car and the end face of the buffer remote from the car being in substantially the same vertical plane perpendicular to the longitudinal direction of the car. A linkage arrangement responds to movement of the buffer toward and away from the car for moving the platform part toward and away from the end of the car so as to maintain the end faces of the buffer and platform part in substantially the same vertical plane. Deflecting blocks are carried by the outer sides of the connecting platform for engagement by the buffers of the other railroad car, the deflecting blocks being tapered toward the end of the railroad car which carries them.

3 Claims, 5 Drawing Sheets

RAILROAD CAR CONNECTION ASSEMBLY WITH MOVABLE PLATFORM ADJUSTABLY CONNECTED TO THE CAR TO COINCIDE WITH MOVEMENT OF CAR BUFFERS

The invention relates to the end face of a passenger train car, and more particularly to the connecting platform associated with the end face of the car.

The crossover between cars is disposed between the two buffers on the end faces of the cars of a passenger train. The top edge of the buffer is situated, as seen vertically, in the area of the connecting platform. Furthermore, there can be a vertical difference of as much as 85 mm between two coupled cars due to wheel wear and springing action.

The spring strength of the buffers can differ. The spring force of the transitions (sliding gasket or rubber bolsters) can likewise differ.

Therefore, there is no assurance that the contact faces of the buffers and the contact faces of the bellows will be directly against one another when the cars are coupled. Consequently, a misalignment occurs between these two surfaces.

In consideration of these problems the invention proposes to construct the end face of a railroad passenger car so that the end of the connecting platform remote from the end face remains in approximately the same plane as the end face of the buffer.

The invention is especially directed to a crossover system in accordance U.S. patent application Ser. No. 318,697, filed Mar. 3, 1989, now U.S. Pat. No. 4,942,825. To prevent the buffers from colliding with and destroying the frame of the crossover platform, when the cars shift transversely with respect to each other on sharp S-curves, each buffer upon compression actuates a lever by which cables or rods pull the sliding bellows back against a spring force. In this manner, variations in the difference between the contact surfaces of the buffers, and the sliding contact surfaces of the connecting platforms between two coupled cars, are minimized. For the sake of safety, ramps are provided on the right and left sides of the bridge frame, and the crossover is held in a certain position in relation to the buffers by a return device.

Figure 1:
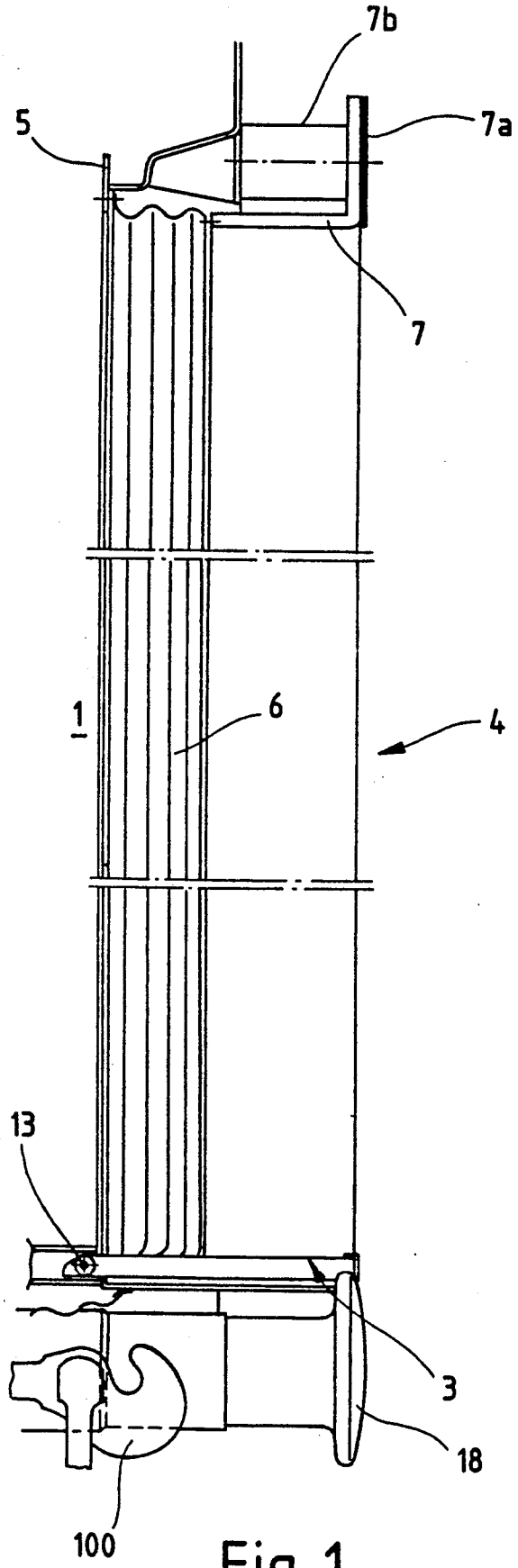
Figure 2:
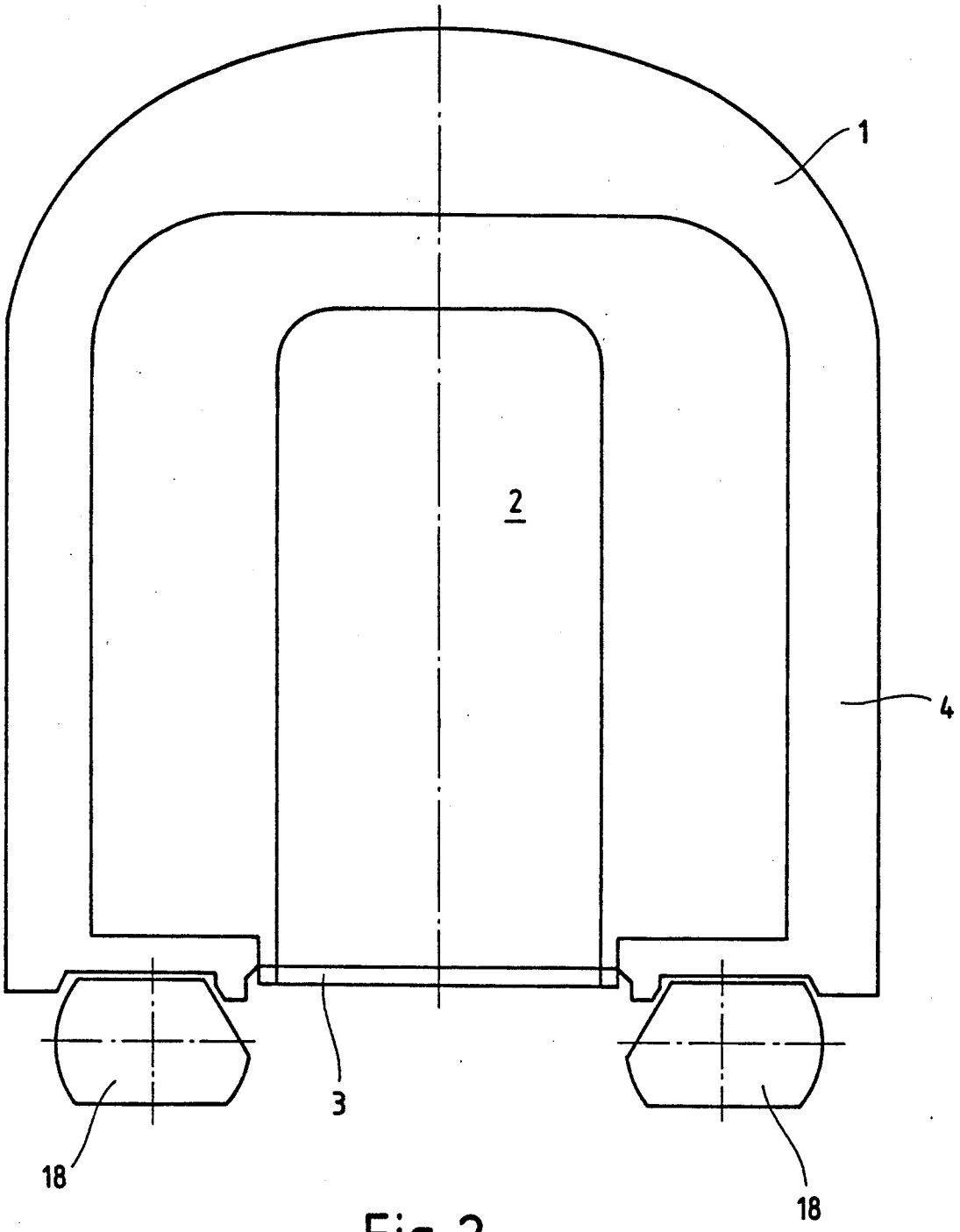
Figure 3:
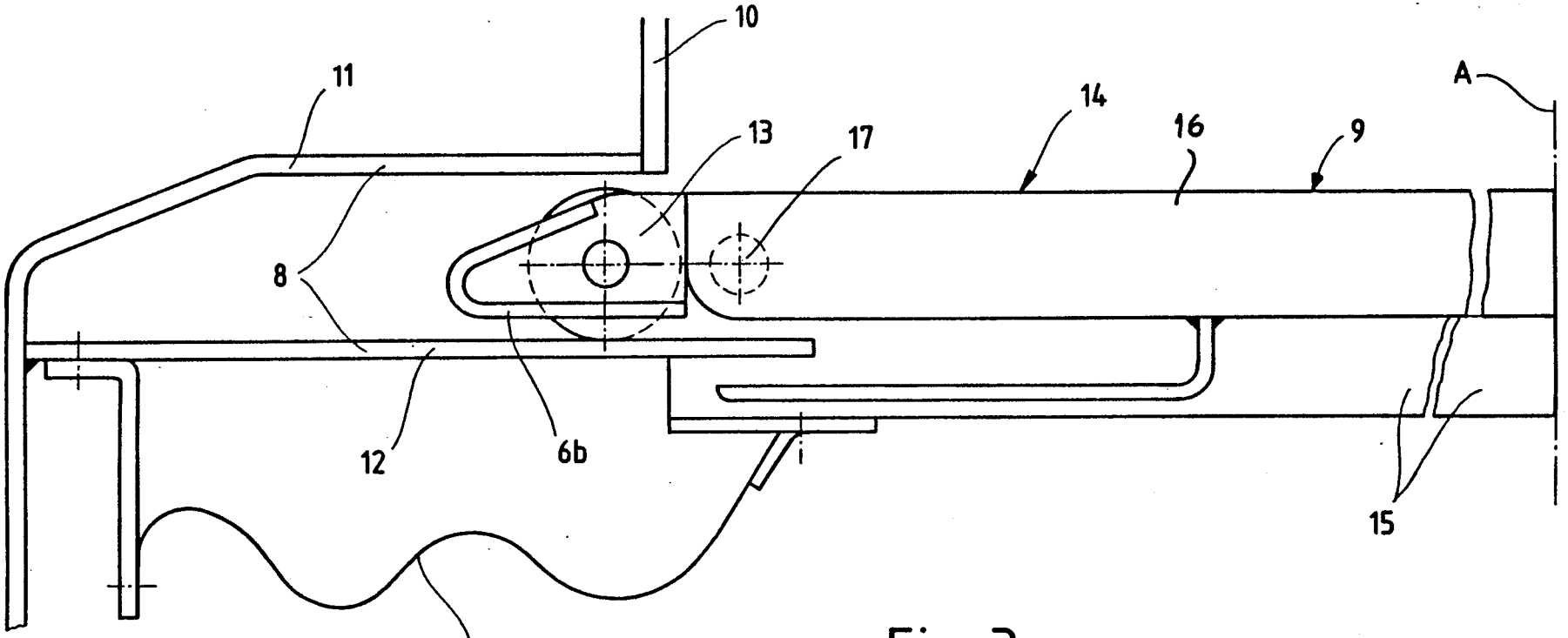
Figure 4:
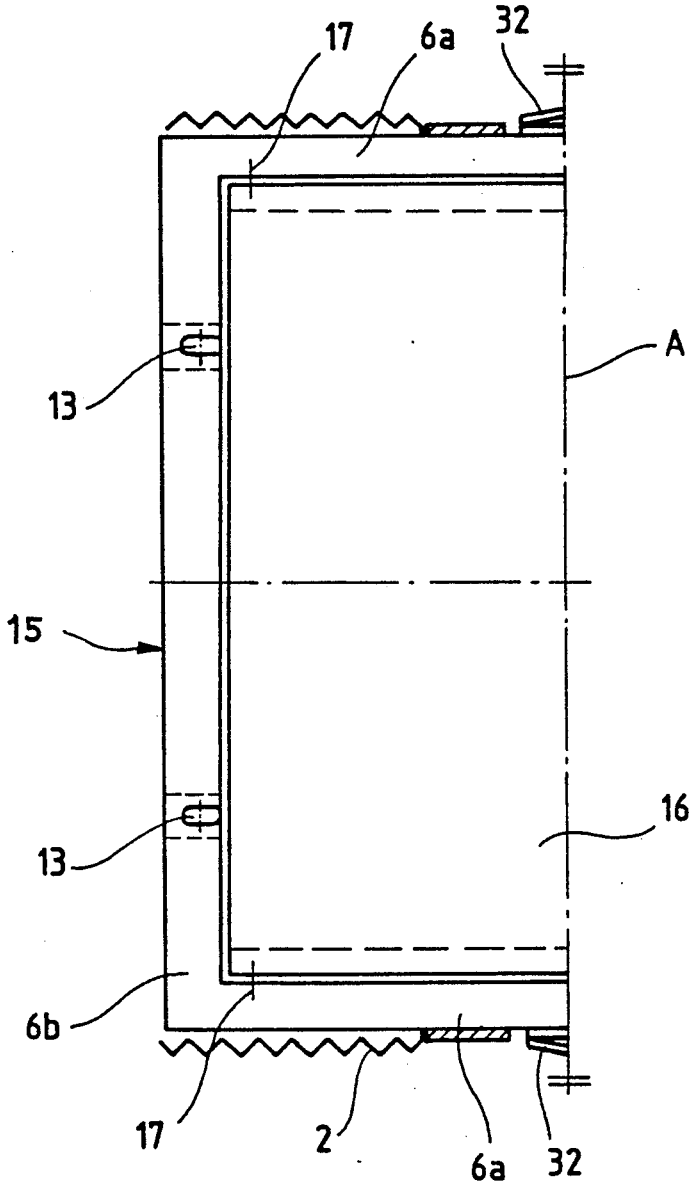
Figure 5:
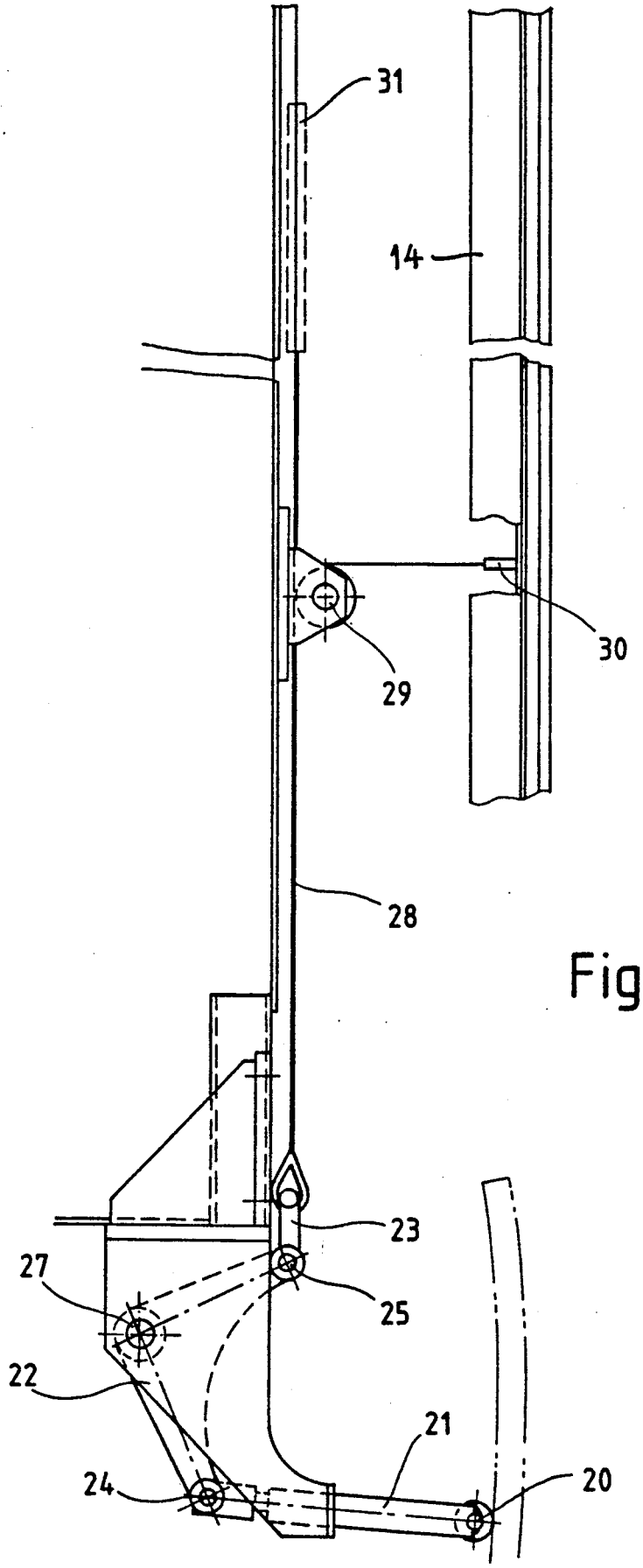

The invention is further explained below with the aid of the drawings, wherein:

FIG. 1 is a diagrammatic representation of a side view of the one end face of a railroad passenger car, this end face being constructed in accordance with the invention, FIG. 2 is a face view of the car end face represented in FIG. 1, FIG. 3 is an enlarged side view of the lower area of the car's end face, FIG. 4 is a greatly simplified top view of the load-bearing part of the crossover, and FIG. 5 is a top view of one side portion of the car's end face.

The end face of a railroad passenger car 1 (FIGS. 1 and 2) has a doorway which can be closed by a door 2, so as to make it possible, when the door is open, for persons to cross over to a coupled second car of a train. For this purpose, a connecting platform 3 is placed below the doorway on the car end face that is represented, and it is continuous with the corresponding connecting platform of the second car when the cars are coupled.

To enable persons to cross over unaffected by the weather, air turbulence, and the like, the connecting platform is disposed in a tunnel-like or tube-like platform cover 4, which includes a rear end frame 5, a bellows 6, and a front end frame 7 as its essential components. The platform cover is fastened to the car end face by its rear end frame 5, and the front end frame serves to fasten the platform shelter to the front end frame of a matching platform shelter of the coupled second car. The bellows 6 provides the platform shelter with the necessary flexibility to adapt to the different conditions of installation and operation.

The distance between the car end face and the front end frame 7 can be divided up appropriately between the front end frame 7 and bellows 6, as long as the necessary flexibility is assured. The front side of the front end frame is preferably a sliding surface **7*a*, and between this end frame and the end of the car, springs 7*b* acting longitudinally of the car can be disposed. Springs 7*b*** create a bias between the front end frames of two coupled cars such that no mechanical fastening between them is necessary, but both end frames are able to slide relative to each other in the transverse and vertical direction within the necessary and allowable limits. The springs can be configured such that the front end frame is also directly suspended on the end face of the car. The flexible part of the platform cover does not necessarily have to be a bellows; in some cases, for example, it can be a bolster pad or a series of several bolster pads.

Just as the bellows 6, or other flexible part of the platform cover, permits or does not interfere with relative movements between two cars coupled together, so too the connecting platform 3 must not cause any interference of this kind. Accordingly, the platform consists of at least two parts 8 and 9 (FIG. 3) which are displaceable relative to one another. Part 8 is held on the end face of the car, part 9 on the front end frame 7. In this system, it is desirable to support the front end frame, as stated above, directly on the car end face, in order to let platform part 9 be supported on platform part 8, but to keep the supporting forces so low that no undesirable impairment of the relative movements between two platform parts 8 and 9 will occur.

The platform cover and connecting platform together constitute a crossover system. The construction of this crossover system described above is set forth in detail in U.S. patent application Ser. No. 318,697 filed Mar. 3, 1989, now U.S. Pat. No. 4,942,825. The present application relates especially, though not exclusively, to this construction of the crossover system.

In regard to the present invention, it is essential in the case of the previously proposed construction of the crossover system that, in accordance with FIG. 3, the end face 10 of the car has a pocket 11 reaching back into the floor structure of the car, the bottom 12 of which projects beyond the end face 10. In the pocket 11, the rear end of a platform structure 14 (called "platform part 9" above) is supported for displacement lengthwise of the car (on wheels 13 or corresponding sliding shoes). The front end of structure 14 is joined to the front end frame by joining a fork-like supporting frame 15 fixedly at the front ends of the branches **6*a* of the fork to the front end frame 7. The crotch part 6*b* of the supporting frame is supported by wheels 13, or corresponding slide shoes, on the bottom plate 12 affixed to the car, and a treadplate 16 (FIG. 4) is pivoted on it at the joints 17. The treadplate can be walked on and covers the area between the forked supporting frame in its operative state, but when inoperative lies in front of the car's end face, so that the coupler 100 (FIG. 1**), situated in the space between the forked supporting frame, is accessible.

Now, it will be seen, especially in the case of the described construction, that only within certain relative movements between two cars coupled together can the danger be avoided of having the buffers 18 collide, especially with the supporting frames, and damage them.

If two cars are coupled together, the buffer springs should have such an equal bias that they will be in contact with one another, in the center between two cars, as long as normal running conditions prevail, and the buffer springs are still applying forces opposed to each other in the same manner. This is the case at least approximately in a vertical transverse plane A (FIGS. 3 and 4) in which the front end frames of both platform cover systems, as well as the treadplates 16 and the front ends of the lateral parts 15 of the forked supporting frame, lie one against the other.

If substantially transversely directed horizontal movements away from this running position take place between the two cars, conditions can arise in which the buffers 18 drift laterally relative to the crossover system and, depending on the cause of this change in the running situation, the buffers of the one side of the connecting platform close in on each other. This will do no harm even if, owing to the installation, the top edge of the buffer is at a greater distance above the rail head than the bottom edge of the crossover system, as long as no contact occurs between the crossover system and buffers, or as long as the front edges of the crossover systems and buffers of both cars lie in the above-mentioned plane A. If, in the latter case, the buffers on one side come correspondingly close to the crossover system, they may penetrate between the two connecting platforms and push into their pockets, with a temporary formation of a gap, without causing any harm.

If the conditions change, the danger exists that the buffers in contact will no longer be able to penetrate between the two connecting platforms as the crossover systems are approached, but may approach the crossover system in the area of the fork branch 5, and finally collide with the latter and damage it. This danger can occur in quite normal railroad operation even when negotiating a tight curve, on the inside of such a curve, if one buffer is forced back more strongly in its guide while the other protrudes correspondingly further out of its guide, and the crossover system does not adjust itself in precisely the same degree. This danger can exist in a special degree if, after a long period of operation, the conditions originally present change; causes for this are mentioned in the introduction hereto.

To forestall this danger, the buffers and crossover system of each car are coupled together, in accordance with the invention, so that the connecting platform follows the adjusting movements of the buffers. In this way, buffers 18 and the front edges of the connecting platform, i.e., the lateral fork-branch-like parts 15 of the chassis and of the treadplate 16, match one another independently of the position of the buffers, i.e., lie in a common vertical transverse plane. For this purpose, by way of example but also in a preferred embodiment, to each buffer 18 or buffer plate of each of the coupled cars, an articulation is linked at a joint 20 (FIG. 5), and its levers 21, 22 and 23 are linked together at joints 24 and 25. Bell crank 22 is mounted pivotingly at a fulcrum point 27 on the particular car, and lever 23 is connected to a pull cable 28. Cable 28 is carried around a pulley 29 and affixed at a point 30 on the platform structure 14, and has a cable tightener 31. In this manner well-coordinated longitudinal movements of buffers and connecting platform are largely assured, in the preferred case of the described construction of the crossover system.

The connecting platform can be protected against collision with the buffers under the circumstances of operation described above, either as an alternative, in the case of simpler requirements, or as an addition, in the case of special requirements. In the case of special requirements, the crossover system or connecting platform can be protected against colliding with the buffers by controlling the platform movements in accord with the buffer movements, while nevertheless providing for the circumstance that relative movements which as a rule are unforeseeable might occur, or that the control system in accordance with the invention might fail.

In this alternative, but preferably additional, arrangement, buffer deflecting means are associated with the outside of each fork branch 15. In the case of other platform designs, buffer deflecting means are associated with other platform components, namely, in the area in which the buffers would come in contact with the fork branches 15 if the crossover systems of two cars would retain their initial position better than the buffers acting between two cars. These buffer deflecting means are blocks 32 (FIG. 4) fastened to the outer sides of the fork branches. The outside surfaces of the blocks are ramped so that a colliding buffer will cause the platform to deflect increasingly laterally since the distance between the ramp surface and the fork branch surface becomes increasingly narrower toward the end face of the car (FIG. 4). These deflecting movements lead, in the case of the preferred platform construction, to lateral shifting movements between the friction surfaces 7*a* of the front end frame 7, and are therefore possible or very easy to achieve in the case of this arrangement.

We claim:

1. For use with the end of a railroad car having at least one spring-biased buffer movable with respect tot he car in a direction parallel to the longitudinal direction of the car, a connecting platform comprising:

a platform part supported on the end of the railroad car but unsupported by the buffer, the platform part being slidable with respect to the car in the longitudinal direction of the car, the end face of the platform part remote from the car and the end face of the buffer remote from the car being in substantially the same vertical plane perpendicular to the longitudinal direction of the car, and means responsive to movement of the buffer toward and away from the end of the car for moving the platform part toward and away from the end of the car so as to maintain the end faces of the buffer and platform part in substantially the same vertical plane.

2. A connecting platform as defined in claim 1 wherein the responsive means includes a lever pivotally mounted about a pivot axis fixed with respect to the railroad car, a first link interconnecting the buffer and the lever, and a second link interconnecting the platform part and the lever.

3. A connecting platform as defined in claim 2 wherein the first link includes a rigid element pivotally interconnecting the buffer and lever, and the second link includes a flexible cable extending between the platform part and the lever.

* * * * *